US008453615B2

(12) United States Patent
Lettmann et al.

(10) Patent No.: US 8,453,615 B2
(45) Date of Patent: Jun. 4, 2013

(54) ADJUSTABLE CAMSHAFT

(75) Inventors: Markus Lettmann, Kieselbronn (DE); Falk Schneider, Korntal-Münchingen (DE)

(73) Assignee: Mahle International GmbH (DE)

( * ) Notice: Subject to any disclaimer, the term of this patent is extended or adjusted under 35 U.S.C. 154(b) by 676 days.

(21) Appl. No.: 12/440,381

(22) PCT Filed: Sep. 4, 2007

(86) PCT No.: PCT/EP2007/059223
§ 371 (c)(1),
(2), (4) Date: Jan. 4, 2010

(87) PCT Pub. No.: WO2008/028902
PCT Pub. Date: Mar. 13, 2008

(65) Prior Publication Data

US 2010/0108004 A1 May 6, 2010

(30) Foreign Application Priority Data

Sep. 7, 2006 (DE) ..... 10 2006 041 918

(51) Int. Cl.
*F01L 1/34* (2006.01)

(52) U.S. Cl.
USPC ..... 123/90.17

(58) Field of Classification Search
USPC ..... 123/90.15, 90.17, 90.6
See application file for complete search history.

(56) References Cited

U.S. PATENT DOCUMENTS

| | | | | |
|---|---|---|---|---|
| 5,235,939 | A | 8/1993 | Levin et al. | |
| 6,035,818 | A | 3/2000 | Sato et al. | |
| 7,284,517 | B2 * | 10/2007 | Lancefield et al. | 123/90.17 |
| 7,287,499 | B2 * | 10/2007 | Lawrence et al. | 123/90.17 |
| 2005/0051123 | A1 | 3/2005 | Haser et al. | |
| 2006/0207529 | A1 * | 9/2006 | Lawrence et al. | 123/90.6 |
| 2008/0257290 | A1 | 10/2008 | Lettmann et al. | |

FOREIGN PATENT DOCUMENTS

| | | |
|---|---|---|
| DE | 3624827 | 2/1988 |
| DE | 19757504 | 7/1999 |
| DE | 19903633 | 8/1999 |

(Continued)

OTHER PUBLICATIONS

English abstract provided for DE-19757504.

(Continued)

*Primary Examiner* — Thomas Denion
*Assistant Examiner* — Daniel Bernstein
(74) *Attorney, Agent, or Firm* — Rader, Fishman & Grauer PLLC

(57) ABSTRACT

The present invention relates to an adjustable camshaft (1), wherein inner and outer shafts (4, 2) connected securely with cams (5, 6) can be rotated relative to each other. In order to obtain this relative movement, at least one hydraulic adjusting device (3) is provided at one end of the camshaft (1), wherein a rotor (2) is rotatable in relation to a stator (19), and the rotor (20) and the stator (19) are each connected securely with one of the two shafts (2, 4). It is essential to the invention that the camshaft (1) is part of a prefabricated camshaft assembly, comprising at least the following components oriented relative to each other: camshaft (1) comprising inner shaft (4), outer shaft (2), cams (5, 6) and adjusting device (3) and a chain wheel (10).

9 Claims, 2 Drawing Sheets

FOREIGN PATENT DOCUMENTS

Figure 1:
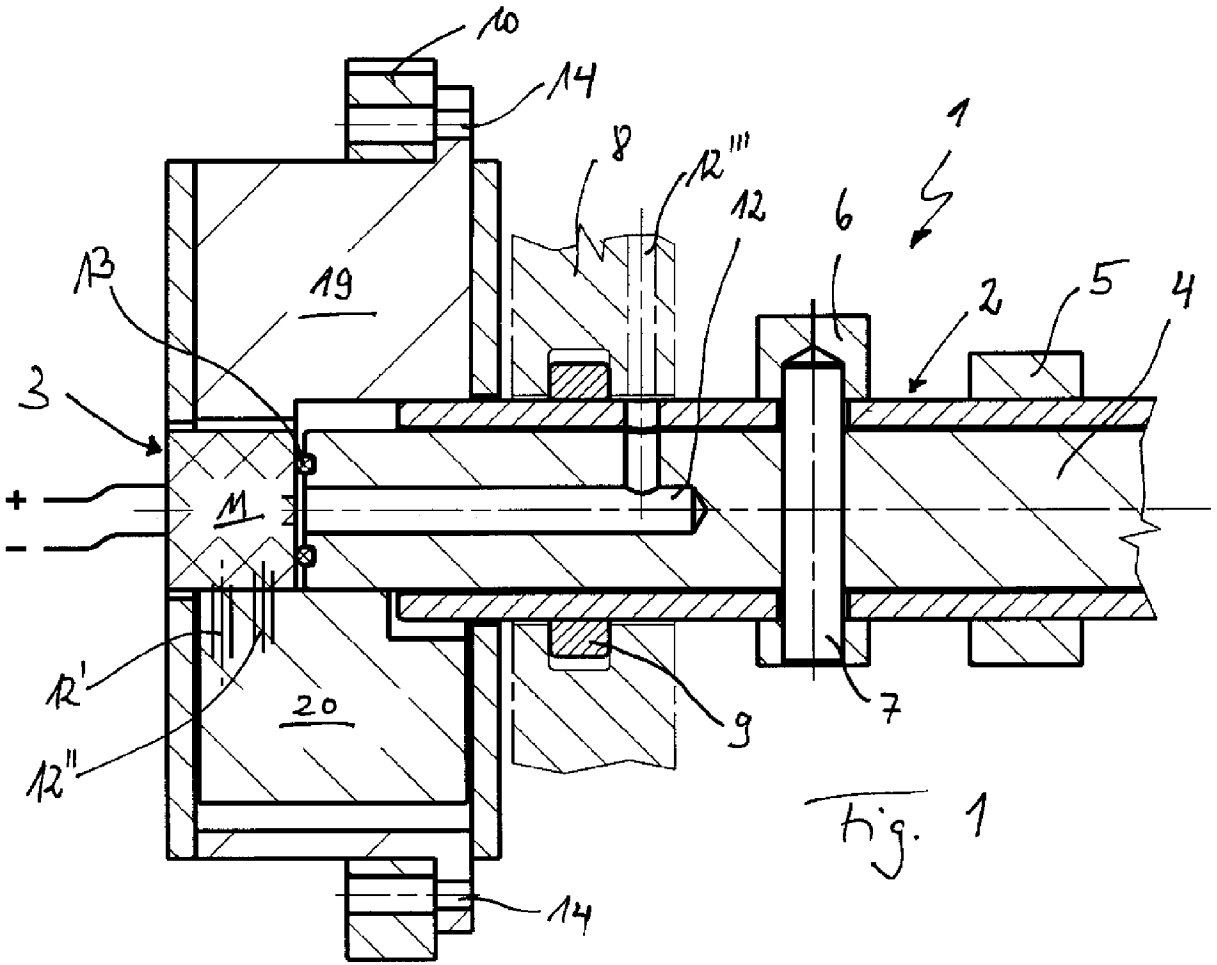

| | | |
|---|---|---|
| DE | 1286024 | 2/2003 |
| DE | 10211468 | 9/2003 |
| DE | 102005014680 | 8/2006 |
| EP | 1234954 | 8/2002 |
| EP | 1696107 | 8/2006 |
| GB | 2415745 | 1/2006 |
| JP | 64-19004 | 1/1989 |
| JP | 61-55102 A | 6/1994 |
| JP | 7-14105 | 3/1995 |
| WO | WO-03/078804 | 9/2003 |
| WO | WO-2006081789 A1 | 8/2006 |

OTHER PUBLICATIONS

English abstract provided for DE-3624827.
English abstract EP-1286024.
English translation of JP Office Action dated Jul. 18, 2012.

* cited by examiner

ADJUSTABLE CAMSHAFT

CROSS-REFERENCES TO RELATED APPLICATION

This application is a National Stage application which claims the benefit of International Application No. PCT/EP2007/059223 filed Sep. 4, 2007, which claims priority based on German Patent Application No. DE 102006041918.9, filed Sep. 7, 2006, both of which are hereby incorporated by reference in their entirety.

The invention relates to an adjustable camshaft, in particular for internal combustion engines of motor vehicles, as per the preamble of patent claim 1.

To be able to increase the power of an internal combustion engine as a function of a respective load state, it is conventional to adapt the valve control times. Here, such an adaptation conventionally takes place by means of a so-called phase adjuster which, in adjustable camshafts, can influence a rotational angle position of a cam. In adjustable camshafts of said type, however, high quality demands are made of the assembly accuracy; it is necessary in particular for the adjustable camshafts or the individual components to be aligned precisely with respect to one another in order to obtain the desired increase in power. The assembly of such adjustable camshafts is correspondingly more complex and expensive as a result.

The invention is concerned with the problem of specifying, for a generic camshaft, an improved or at least different embodiment which is distinguished in particular by a considerably reduced installation/assembly expenditure.

Said problem is solved according to the invention by means of the subject matter of independent claim 1. Advantageous embodiments are the subject matter of the dependent claims.

The invention according to claim 1 is based on the general concept of reducing the assembly expenditure in the production of internal combustion engines for motor vehicles by using the greatest possible number of prefabricated assemblies, thereby making it unnecessary for individual components of the assembly to be adjusted with respect to one another, as is required conventionally, during installation. For this reason, the camshaft is a constituent part of a camshaft assembly which can be prefabricated and which comprises at least the following components which are already aligned relative to one another before installation into the internal combustion engine: a camshaft with an inner and an outer shaft, cams belonging to the inner and outer shafts, an actuating device and a sprocket. Here, the camshaft is designed as an adjustable camshaft with the abovementioned inner and outer shafts, wherein the cams belonging to the inner shaft are fixedly connected to the inner shaft in each case by means of a pin connection, while the cams belonging to the outer shaft are preferably shrink-fitted onto the latter. To be able to influence the valve control times, the inner shaft and the outer shaft are mounted so as to be rotatable relative to one another, with a relative rotation between the two shafts being generated by means of at least one in particular hydraulic actuating device which is arranged at one end of the camshaft and in which a rotor is rotatable relative to a stator, with at least one being fixedly connected to one of the two shafts. It is preferable for the rotor to be fixedly connected to the one shaft and for the stator to be fixedly connected to the other shaft. This may involve a so-called SCP (single cam phaser) camshaft which, for the prefabrication of the camshaft assembly, is placed into a device in which the axial positioning and an angular alignment of the cams is fixed. The at least one actuating device, which is also referred to as a phase adjuster, is placed into a similar device, with an angular alignment taking place preferably by means of the sprocket. The actuating device and the camshaft are subsequently joined together to form the camshaft assembly, with this preferably taking place by means of the actuating device being heated and subsequently shrink-fitted onto the associated shafts. By means of the camshaft assembly according to the invention, it is possible for the previously complex assembly of a camshaft, in particular of an SCP camshaft, to be considerably simplified since an alignment of the individual components now takes place already during the prefabrication of the camshaft assembly and not, as was previously conventional, during the mounting of the camshaft into a crankcase.

The rotor and the stator of the actuating device are expediently connected to the associated shaft by means of joining, adhesive bonding, screwing and/or welding. Here, the expression "joining" is to be understood to mean, in terms of production technology, the permanent connection of at least two components. With a shrink fit in particular, it is possible to obtain simple, cost-effective and very reliable joining of the actuating device to the camshaft, such that shrink fitting is preferably used. Also conceivable is in particular a screw connection, for example of the rotor to the inner shaft and of the stator to the outer shaft, by means of an internal thread which is screwed onto a corresponding external thread.

In one advantageous embodiment of the solution according to the invention, at least one control valve for activating the rotor and the stator of a hydraulically actuable actuating device is arranged at the longitudinal end side in the inner shaft and within the actuating device. Such an arrangement provides installation-space-minimizing accommodation of the at least one control valve within the camshaft or within the actuating device, thereby making allowance for the ever-decreasing availability of installation space in engine bays of motor vehicles.

In a further advantageous embodiment with a hydraulically-operating phase adjuster, a hydraulic duct which supplies the at least one control valve is arranged in the rotational axle of the camshaft, preferably coaxially in the inner shaft, and, at an end remote from the actuating device, is guided radially outward through the outer shaft. In contrast to a conventional activation of a hydraulic actuating device, in which two hydraulic ducts are required, only one hydraulic duct which is to be supplied is now provided as a result of the control valve according to the invention, since the control valve brings about the division of the hydraulic flow between the respective chambers in the actuating device. Here, the arrangement of the hydraulic duct in the inner shaft represents a space-saving alternative to an external supply of the hydraulic liquid to the actuating device. In an embodiment in which the at least one control valve is also arranged at the longitudinal end side in the inner shaft and within the actuating device, it is possible to avoid complex seals for sealing the hydraulic duct in the region between the latter and the hydraulic actuating device, as a result of which the hydraulic supply to the actuating device can be of structurally simpler design.

Figure 2:
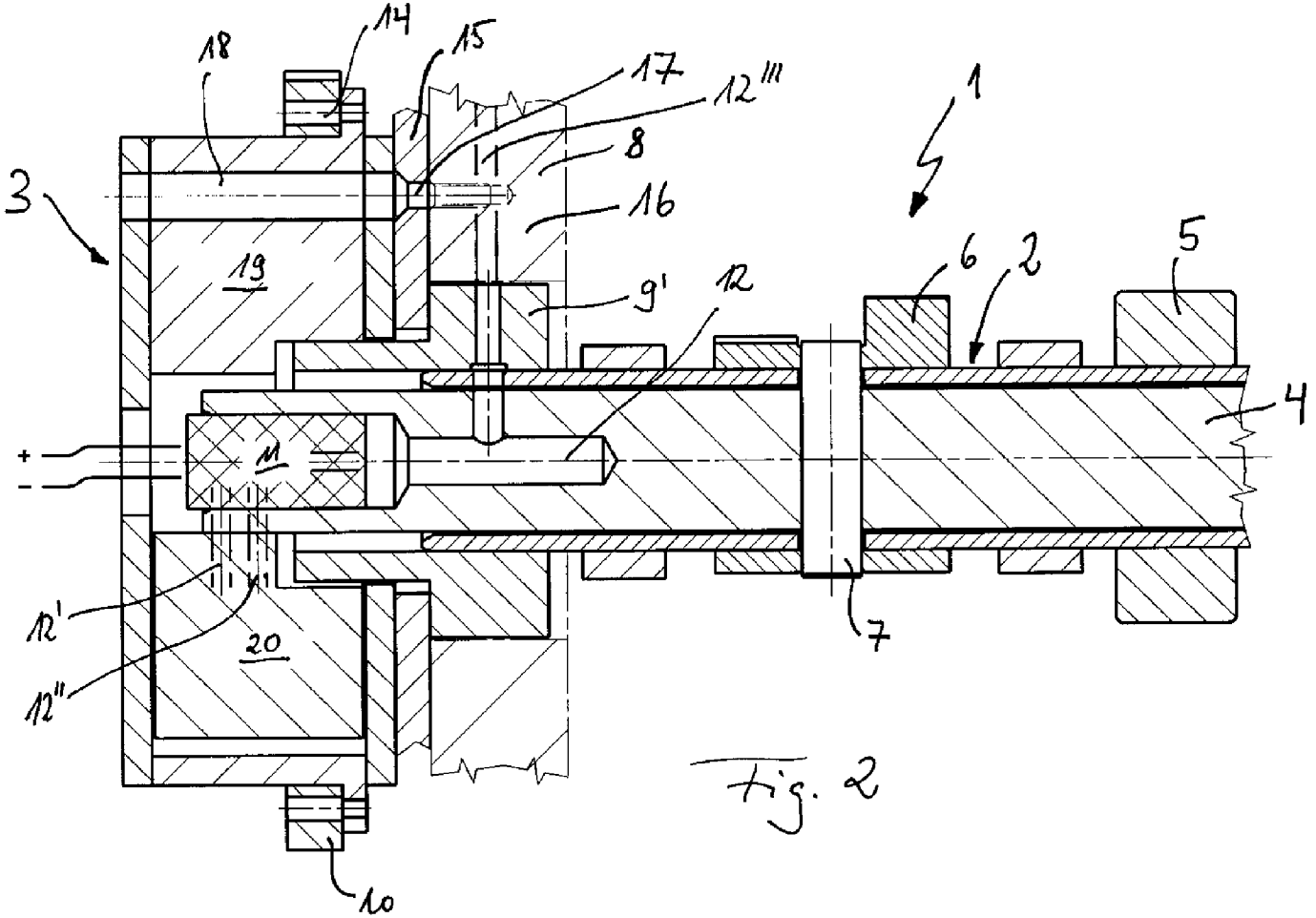

Advantageous exemplary embodiments, which are explained in more detail below, are illustrated in the drawings, in which, in each case schematically, FIG. 1 shows a section illustration through a camshaft assembly according to the invention, in which a control valve is arranged at the longitudinal end side of the inner shaft and within the actuating device, FIG. 2 shows an illustration as in FIG. 1, but with a control valve arranged within the inner shaft and within the actuating device.

Corresponding to FIG. 1, an axial end region of an adjustable camshaft 1 has an inner shaft 4 which is rotatably mounted in an outer shaft 2 by means of a hydraulic actuating device 3. The two shafts 2 and 4 have cams 5 and 6, fixedly connected thereto in each case, for controlling the valves of an internal combustion engine, with the cams 5 being fixedly connected to the outer shaft 2 and the cams 6 being rotationally fixedly connected by means of a pin connection 7 to the inner shaft 4. Here, the pin connection 7 runs through the outer shaft 2, such that it is possible for the inner shaft 4 with the cams 6 connected thereto by means of pins to perform an independent rotational movement with respect to the outer shaft 2.

As mentioned above, to generate a relative rotation between the inner shaft 4 and the outer shaft 2, the hydraulic actuating device 3 is provided, in which hydraulic actuating device 3 a rotor 20 is rotatable relative to a stator 19, with the rotor 20 and the stator 19 in each case being fixedly connected to one of the two shafts 2, 4. Here, it is preferable for the stator 19 to be fixedly connected to the outer shaft 2 while the rotor 20 is fixedly connected to the inner shaft 4. Furthermore, the outer shaft 2 is fixedly connected, adjacent to the actuating device 3, to a bearing ring 9 which serves to mount at least the outer shaft 2 in a positionally fixed first bearing 8. Here, said bearing ring 9 is preferably joined to the outer shaft 2 in a similar way to the cams 5, and is in particular shrink-fitted onto said outer shaft 2, wherein in the embodiment in FIG. 1, the bearing 8 is designed as a separable bearing with corresponding bearing shells 16 and fixes the camshaft 1 in the axial direction.

Here, FIGS. 1 and 2 show only one actuating device 3, wherein the invention is also intended to encompass the arrangement of two actuating devices 3 for the independent adjustment of the inner shaft 4 with respect to the outer shaft 2.

According to the invention, the camshaft 1 is now a constituent part of a camshaft assembly which can be prefabricated and which comprises at least the following components which are aligned or adjusted relative to one another: camshaft 1 with an inner shaft 4 and outer shaft 2, cams 5 and 6, actuating device 3 and a sprocket 10. A camshaft assembly which can be prefabricated in this way can be installed, during a later assembly or production process of the internal combustion engine, with a considerably reduced amount of assembly expenditure, as a result of which the assembly or production costs can be considerably reduced. As mentioned, the camshaft assembly which can be prefabricated includes the hydraulic actuating device 3 which is fixedly connected to the camshaft 1 already before the installation of the camshaft assembly into the internal combustion engine. Here, the rotor 20 and the stator 19 are in particular connected to the respectively associated shaft 4, 2 by means of joining, in particular by means of shrink fitting, adhesive bonding or welding. Here, the joining process of shrink fitting in particular offers a joining process which provides fitting accuracy, which is reliable and which is simple in production terms, as a result of which shrink fitting is preferably used for joining the actuating device 3 to the camshaft 1. The inner shaft 4 is therefore fixed in the axial direction with respect to the outer shaft 2 within the actuating device 3.

It is also expressly conceivable for the rotor 20 to be screwed to the inner shaft 4 and for the stator 19 to be screwed to the outer shaft 2, for example in the case of the stator 19 by means of a stator-side internal thread which is screwed onto a corresponding external thread on the outer shaft.

To control the valve control times of the internal combustion engine, it is necessary for the inner shaft 4 with the associated cams 6 to be rotatable relative to the outer shaft 2 with the associated cams 5. Said rotatability is obtained by means of the hydraulic actuating device 3, wherein individual chambers between the rotor 20 and the stator 19 in the hydraulic actuating device 3 can be activated by means of at least one control valve 11, in particular an electromagnetic control valve. Here, as per the illustration of FIG. 1, the control valve 11 is arranged in the axle of the camshaft 1 and within the actuating device 3, and is therefore accommodated in a space-saving fashion. Here, an arrangement in the axle of the camshaft means, as per the embodiment of FIG. 1, that the control valve 11 is arranged at the end side of the inner shaft 4. The control valve 11 is supplied with hydraulic liquid via a hydraulic duct 12 which is arranged at least in regions coaxially in the inner shaft 4 and, at an end remote from the actuating device 3, is guided radially outward through the outer shaft 2. To be able to ensure an undisturbed flow of hydraulic medium between the crankcase-side hydraulic duct 12''' and the actuating device 3, it is possible at least in the inner shaft 4 for a duct section which runs radially with respect to the shaft 4 to be flared in the manner of a slot in the shaft circumferential direction. It is possible to take corresponding precautions at the transition between the outer shaft 2 and the bearing 8 or the bearing ring 9' according to FIG. 2.

Here, an annular seal 13 is provided on the end side of the inner shaft 4, which annular seal 13 hydraulically seals off a transition between the inner shaft 4, which contains the hydraulic duct 12, and the control valve 11. At the outlet side of the control valve 11, a hydraulic duct 12' and a hydraulic duct 12" lead into an associated chamber (not shown) of the actuating device 3 for adjusting the rotor 20 with respect to the stator 19, and therefore for adjusting the inner shaft 4 with respect to the outer shaft 2.

Before or during the mounting of the camshaft assembly in the internal combustion engine, the sprocket 10 is aligned with respect to the actuating device 3 and is fixed to the actuating device 3 in the aligned position. This may take place for example by means of a connecting means (not shown) which is plugged through, or clamped in, openings 14 which are arranged in alignment with one another in the sprocket 10 and in the actuating device 3.

At its end remote from the actuating device 3, the hydraulic duct 12 extends outward through the outer shaft 2 and, here, communicates with a corresponding hydraulic duct 12''' in the bearing 8.

In contrast to FIG. 1, the camshaft assembly, which can be prefabricated, according to FIG. 2 additionally comprises a thrust bearing disk 15 which functions as an axial bearing and which, when the camshaft assembly is mounted in the crankcase, is arranged between the first bearing ring 9' and the actuating device 3. Here, the thrust bearing disk 15 is conventionally referred to as a thrust plate and is fixedly connected to the bearing 8 for example at least one screw connecting means 17. It is of course also possible for a latching connection or some other suitable connection to be provided between the thrust bearing disk 15 and the bearing 8 or the crankcase. Here, the bearing 8 is preferably a constituent part of the crankcase. To be able to ensure access to the screw connecting means 17 once the actuating device 3 has been connected to the camshaft 1, the actuating device 3 has a cutout 18 in the form of a clearance through which the screw connecting means 17 or other connecting means can be inserted and the thrust bearing disk 15 can subsequently be screwed to the bearing 8 or to the crankcase.

A further contrast with respect to FIG. 1 is that the bearing 8 does not involve separable bearing shells 16 but is rather a tunnel bearing arrangement, such that the camshaft assembly can be pushed into the crankcase. Here, the thrust bearing disk 15 fixes a bearing ring 9', which is fixedly connected to the outer shaft 2, in the one axial direction and fixes the actuating device 3 in the other axial direction and therefore fixes the camshaft 1 itself in the axial direction with respect to the crankcase.

In the embodiment of the camshaft assembly according to FIG. 2, the at least one control valve 11 is arranged at the longitudinal end side in the inner shaft 4 and within the actuating device 3, as a result of which the seal 13 required in FIG. 1 can be dispensed with and as a result of which a particularly space-saving arrangement of the control valve 11 is permitted. Here, the statements made with regard to the hydraulic ducts 12' and 12" and with regard to the sprocket 10 on the basis of FIG. 1 likewise apply to FIG. 2.

As can be seen from FIG. 2, the thrust bearing disk 15 bears against the bearing 8, that is to say against the crankcase, while the actuating device 3 and the bearing ring 9' bear against the thrust bearing disk 15.

A prefabrication process of the camshaft assembly according to the invention as per the variant of FIG. 1 takes place as follows: the camshaft 1, for example an SCP camshaft, is firstly placed into a device which ensures the axial positioning and an angular alignment, preferably at the cams 5, 6. The actuating device 3, also referred to as a phase adjuster, is then placed into a similar device, with an angular relationship taking place preferably by means of the sprocket 10. After said adjustment process, the two parts 1 and 10 are joined together to form the camshaft assembly, with the actuating device 3 preferably being heated for this purpose and shrink-fitted with the rotor 20 or the stator 19 onto the associated shaft 4, 2. To mount the camshaft assembly which is prefabricated in this way, the assembly is placed into the crankcase and the bearing shells 16 of the bearing 8 are subsequently screwed. A chain is then attached to the assembly by means of the sprocket 10 and the screw connecting means, for example sprocket screws, are tightened.

In contrast, the camshaft assembly according to the embodiment of FIG. 2 is mounted in the internal combustion engine by means of the prefabricated camshaft assembly being pushed into the crankcase and the screw connecting means 17 being screwed, or corresponding latching means being latched. Here, the access to the screw connecting means 17 is ensured by means of the cutouts 18 on the actuating device 3.

With the exception of the addition of the thrust bearing disk 15, both the prefabrication process and also the mounting process are otherwise identical to those in the case of the camshaft assembly as per FIG. 1.

Here, all of the features specified in the description and in the following claims may be essential to the invention both individually and also combined with one another in any desired form.

The invention claimed is:

1. An adjustable camshaft, comprising:

an inner shaft, an outer shaft, and cams, the inner shaft and outer shaft fixedly connected to the cams that are rotatable relative to one another to create a relative movement, wherein the cams belonging to the inner shaft are fixedly connected to the inner shaft in each case by a pin connection, an actuating device provided at an end of the camshaft to generate the relative movement, in which the actuating device at least one rotor is rotatable relative to a stator, with the at least one rotor being fixedly connected in each case to one of the inner shaft and the outer shaft, wherein the camshaft is part of a prefabricated camshaft assembly which comprises at least the following components which are in alignment relative to one another: the camshaft with the inner shaft, and the outer shaft, the cams, the actuating device, and a sprocket;

wherein at least one control valve for activating the rotor and the stator is arranged at a longitudinal end side in the inner shaft and within the actuating device;

and wherein a hydraulic duct which supplies the control valve is arranged in regions in the inner shaft and, at an end remote from the actuating device, is guided radially outward through the outer shaft.

2. The camshaft as claimed in claim 1, wherein the rotor and the stator are connected directly to at least one of the inner and outer shaft by means of at least one of the following:

joining, at least partially reciprocal screwing, adhesive bonding and welding.

3. The camshaft as claimed in claim 2, wherein one of the following is selected:

i. including at least one axial bearing for axially fixing the camshaft assembly with respect to a separable bearing, which is fixed with respect to a crankcase, is provided on the outer shaft, and ii. in that the camshaft assembly which is prefabricated additionally comprises a thrust bearing disk which functions as an axial bearing for the camshaft, and where the thrust bearing disk when the camshaft assembly is mounted in a crankcase, is arranged between the crankcase and the actuating device.

4. The camshaft as claimed in claim 1, wherein one of the following is selected:

i. including at least one axial bearing for axially fixing the camshaft assembly with respect to a separable bearing, which is fixed with respect to a crankcase, is provided on the outer shaft, and ii. in that the camshaft assembly which is prefabricated additionally comprises a thrust bearing disk which functions as an axial bearing for the camshaft, and where the thrust bearing disk when the camshaft assembly is mounted in a crankcase, is arranged between the crankcase and the actuating device.

5. The camshaft as claimed in claim 4, wherein the selected thrust bearing disk is connected to a separable bearing, which is fixed with respect to a crankcase.

6. The camshaft as claimed in claim 4, wherein a thrust bearing disk is connected to the selected associated bearing, which is fixed with respect to the crankcase.

7. The camshaft as claimed in claim 1, wherein at least the stator is fixedly connected to the outer shaft.

8. An adjustable camshaft, comprising:

an outer shaft;

an inner shaft configured within the outer shaft;

a plurality of cams, wherein the cams are fixedly connected to one of the inner shaft and the outer shaft, such that the cams are rotatable relative to one another to create a relative movement, and wherein the cams fixedly connected to the inner shaft are connected by a pin connection;

an actuating device having at least one rotor is provided at an end of the camshaft to generate the relative movement, the at least one rotor is fixedly connected in each case to one of the inner shaft and the outer shaft, and the at least one rotor is rotatable relative to a stator, wherein the camshaft is a prefabricated and aligned camshaft assembly, the camshaft assembly comprises at least the following components aligned relative to one another: the camshaft with the inner shaft, the outer shaft, the cams the actuating device, and a sprocket, wherein at least one control valve for activating the rotor and the stator is arranged at an end side of the inner shaft and within the actuating device, and wherein a hydraulic duct which supplies the control valve is arranged in regions in the inner shaft and, at an end remote from the actuating device, is guided radially outward through the outer shaft.

9. An adjustable camshaft, comprising:

an outer shaft;

an inner shaft configured within the outer shaft;

a plurality of cams, wherein cams are fixedly connected to one of the inner shaft and the outer shaft, such that the cams are rotatable relative to one another to create a relative movement, and wherein the cams fixedly connected to the inner shaft by a pin connection;

an actuating device having at least one rotor is provided at an end of the camshaft to generate the relative movement, the at least one rotor is fixedly connected in each case to one of the inner shaft and the outer shaft, and the at least one rotor is rotatable relative to a stator, wherein the camshaft is a prefabricated and aligned camshaft assembly, the camshaft assembly comprises at least the following components aligned relative to one another: the camshaft with the inner shaft, the outer shaft, the cams the actuating device, and a sprocket, wherein a hydraulic duct which supplies a control valve is arranged in regions in the inner shaft and, at an end remote from the actuating device, is guided radially outward through the outer shaft.

* * * * *